US006500101B1

(12) United States Patent
Chen

(10) Patent No.: US 6,500,101 B1
(45) Date of Patent: Dec. 31, 2002

(54) ADJUSTABLE DUMBBELL

(75) Inventor: James Chen, No. 35, Tun Hi Rd., Chin Chan Li, Sa Lu Chen, Taichung Hsien (TW)

(73) Assignees: James Chen, Taichung Hsien (TW); Tony Tsai, Skokie, IL (US)

( * ) Notice: Subject to any disclaimer, the term of this patent is extended or adjusted under 35 U.S.C. 154(b) by 267 days.

(21) Appl. No.: 09/635,854

(22) Filed: Aug. 11, 2000

(51) Int. Cl.[7] ..... A63B 21/075
(52) U.S. Cl. ..... 482/107; 482/108
(58) Field of Search ..... 482/93, 98, 106–109, 482/908

(56) References Cited

U.S. PATENT DOCUMENTS 4,529,198 A * 7/1985 Hettick, Jr. ..... 482/107
5,637,064 A 6/1997 Olson et al.
5,769,762 A 6/1998 Towley, III et al.
5,779,604 A 7/1998 Towley, III et al.
5,839,997 A * 11/1998 Roth et al. ..... 482/107
6,033,350 A * 3/2000 Krull ..... 482/107
D422,654 S * 4/2000 Chen ..... D21/680
6,149,558 A * 11/2000 Chen ..... 482/107
6,186,928 B1 * 2/2001 Chen ..... 482/107
6,196,952 B1 * 3/2001 Chen ..... 482/107
6,228,003 B1 * 5/2001 Hald et al. ..... 482/107
6,261,022 B1 * 7/2001 Dalebout et al. ..... 482/107
6,416,446 B1 * 7/2002 Krull ..... 482/108

* cited by examiner

*Primary Examiner*—Glenn E. Richman
*Assistant Examiner*—Victor Hwang
(74) *Attorney, Agent, or Firm*—Browdy and Neimark, P.L.L.C.

(57) ABSTRACT

An adjustable dumbbell comprises a carrying seat, a plurality of weights, and a selection device. The carrying seat is formed of two support plates and a connection member. The weights are held by the carrying seat by two connection rods. The selection device is mounted on the carrying seat and is formed of an adjusting mechanism, and two rotary rods which are controlled by the adjusting mechanism to move into or out of the through holes of the weight. A user of the dumbbell can use the selection device to pick out a desired weight.

9 Claims, 5 Drawing Sheets

ADJUSTABLE DUMBBELL

FIELD OF THE INVENTION

The present invention relates generally to a body building device, and more particularly to an adjustable dumbbell.

BACKGROUND OF THE INVENTION

The U.S. Pat. Nos. 5,637,064; 5,769,762; and 5,779,604 disclose an adjustable dumbbell comprising a handle and a plurality of weights joined by the handle, by which the dumbbell is lifted or swung about in the hand for muscular exercise. The weights are joined by the handle in conjunction with a U-shaped pin which is provided in the longitudinal direction with a plurality of side forks arranged at an interval. The handle is provided with a plurality of grooves in which the forks of the pin are retained. The weights are selectively joined by the handle by changing the position of the pin. The weights are vulnerable to falling on the ground in the event that the pin is not held securely in the grooves. In addition, the pin and weights are separated from each other, thereby resulting in inconvenience in case of loss or misplacement of the pin.

SUMMARY OF THE INVENTION

The primary objective of the present invention is to provide an adjustable dumbbell which is free from the drawbacks of the adjustable dumbbells of the prior art described above.

In keeping with the principle of the present invention, the foregoing objective in the present invention is attained by an adjustable dumbbell comprising a carrying seat, a plurality of weights, and a selection device. The carrying seat is provided with two support plates opposite to each other, and a connection member located between the two support plates. The weights are held by the carrying seat and are provided in two plate bodies opposite to each other, and a fastening member located between the two plate bodies. Two plate bodies are coaxially provided with a through hole. The selection device is mounted on the carrying seat and is formed of an adjusting mechanism and two rod members which are controlled by the adjusting mechanism to select the weights.

DETAILED DESCRIPTION OF THE INVENTION

Figure 1:
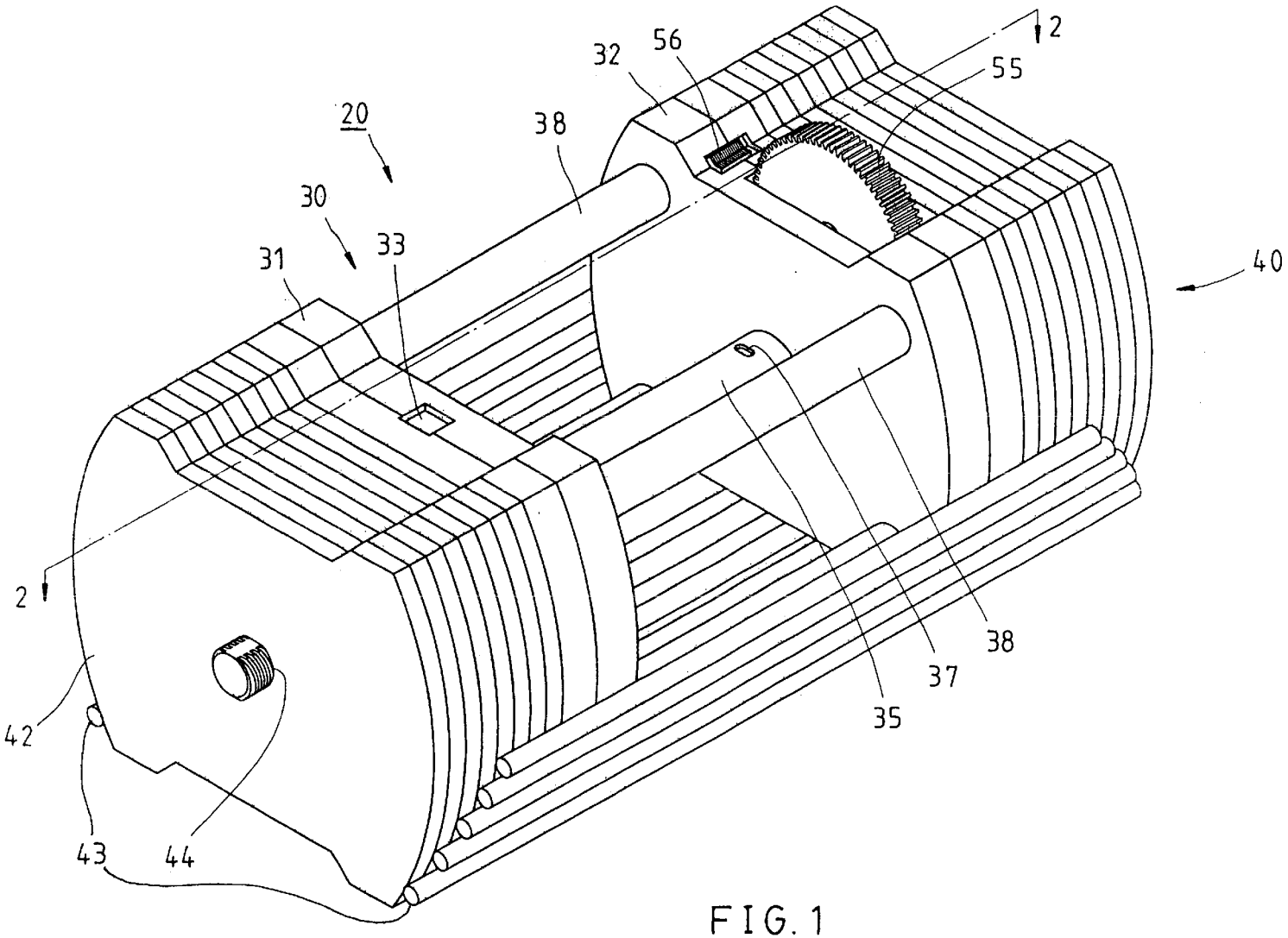
FIG. 1 shows a perspective view of a preferred embodiment of the present invention.
Figure 2:
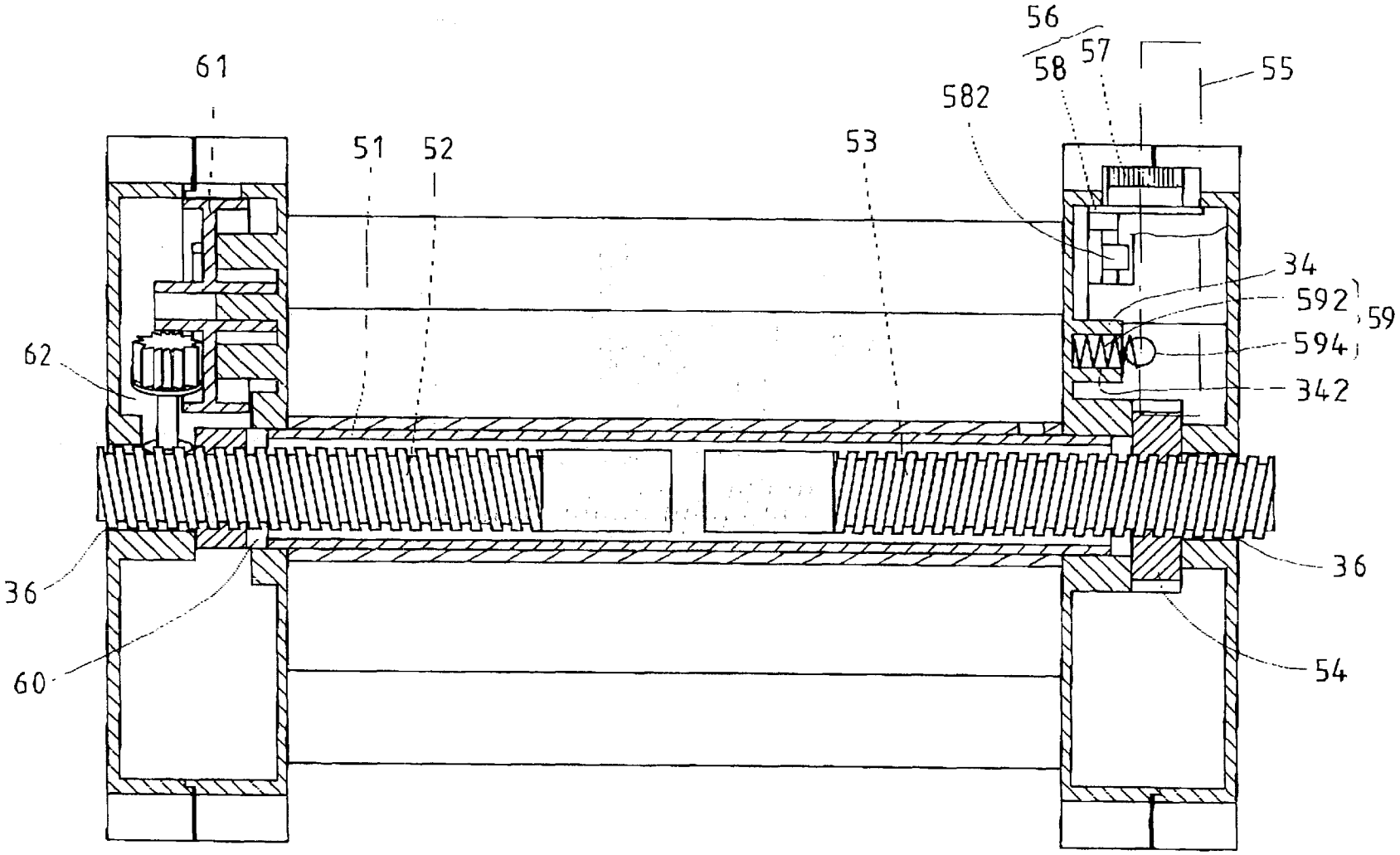
FIG. 2 shows a sectional view taken along the direction indicated by a line 2—2 as shown in FIG. 1.
Figure 3:
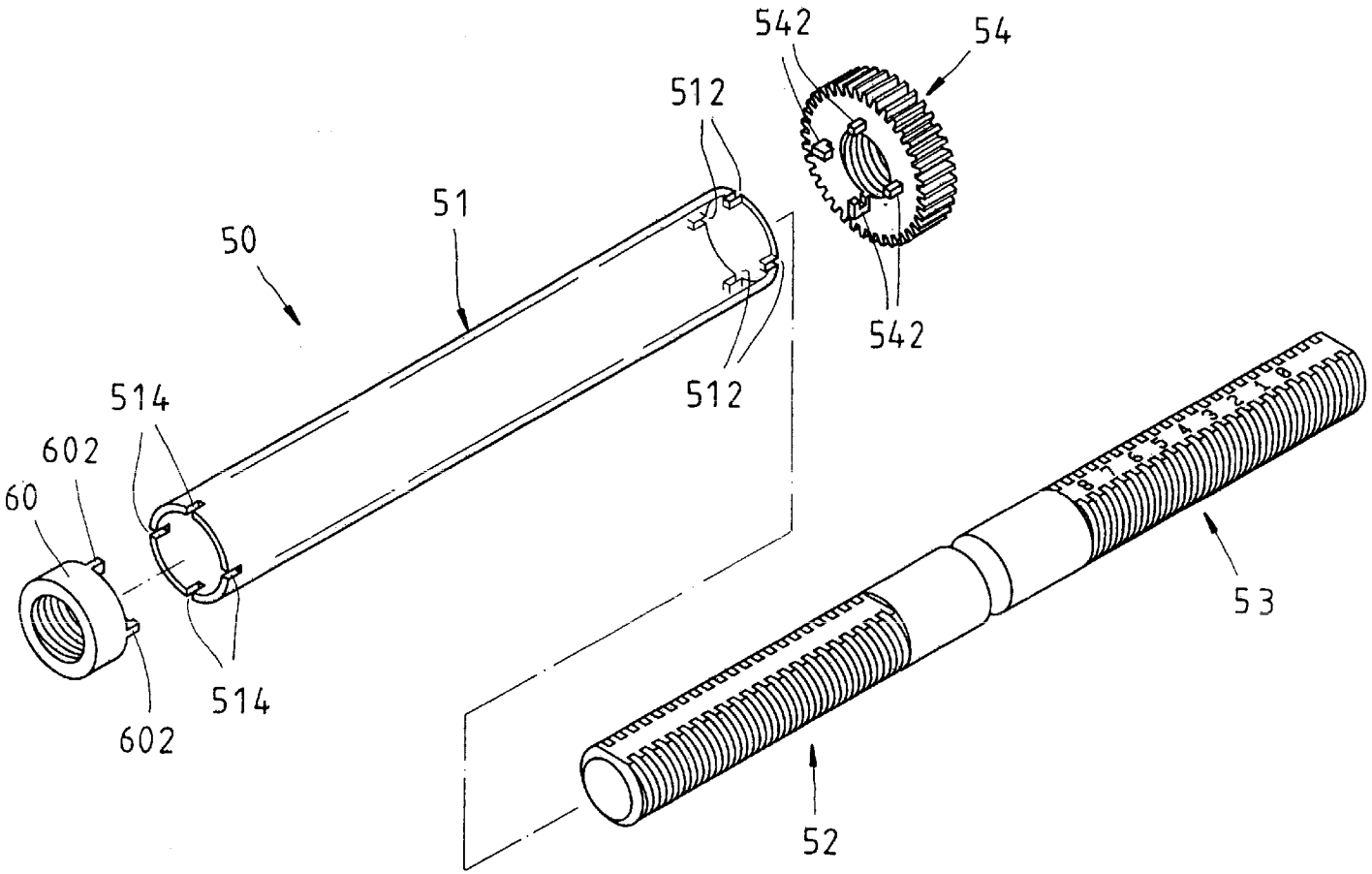
FIG. 3 shows a schematic view of a hollow round rod, a rotary knob, and a sleeve of the preferred embodiment of the present invention.
Figure 4:
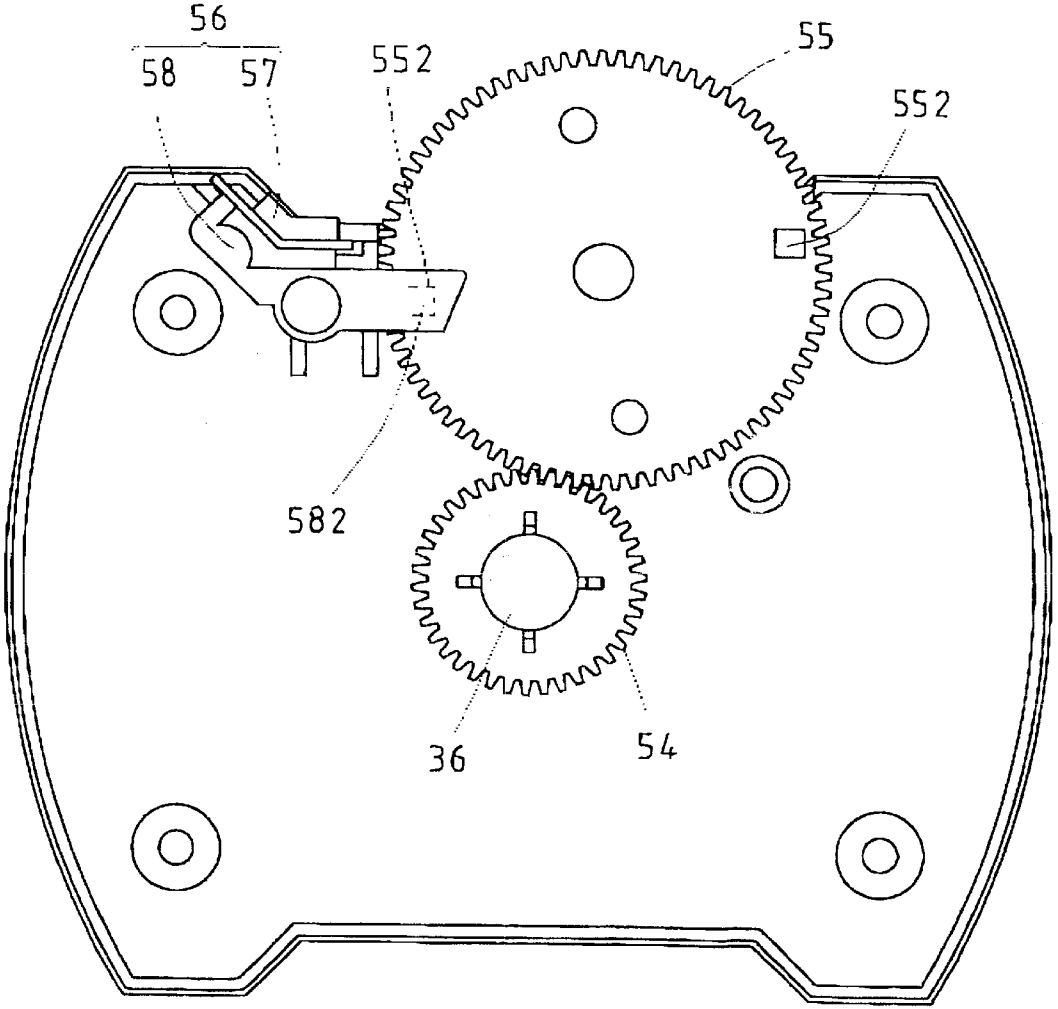
FIG. 4 shows a schematic view of the right support plate of the preferred embodiment of the present invention.
Figure 5:
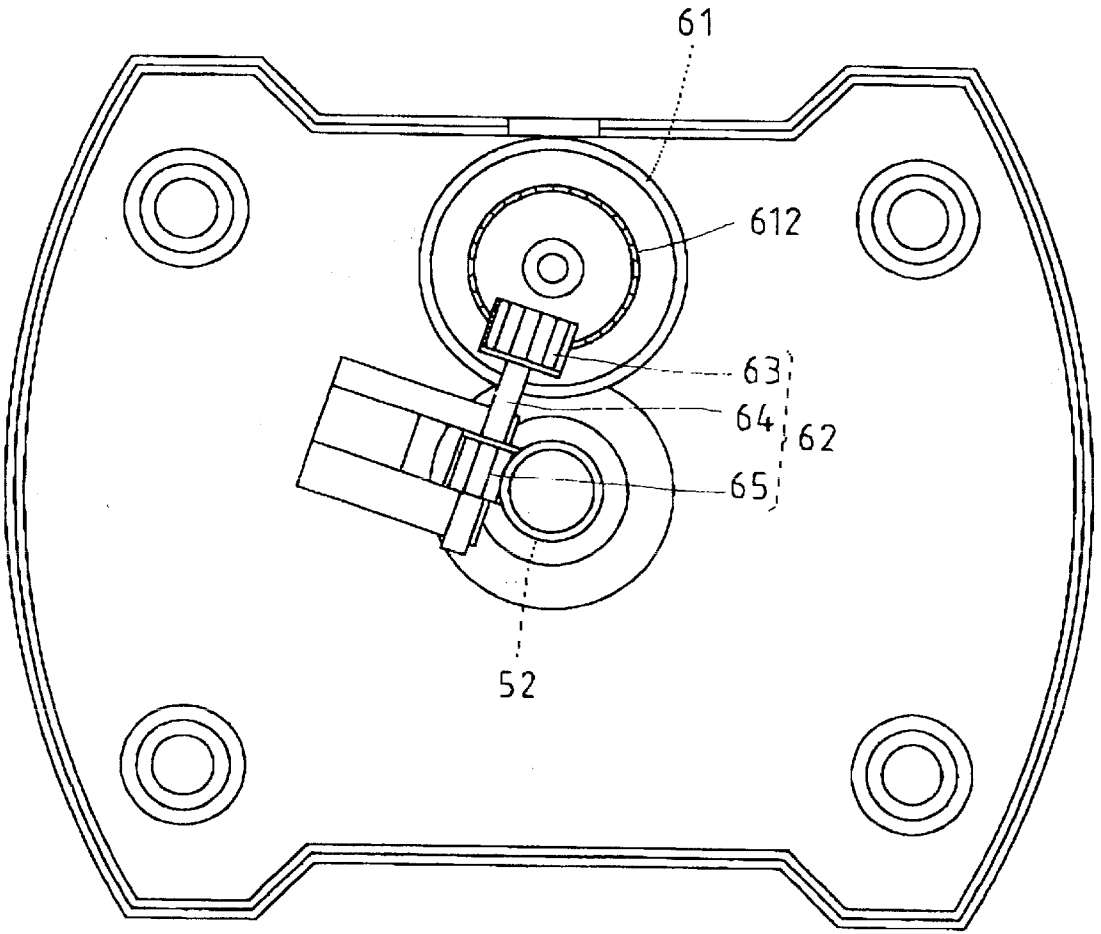
FIG. 5 shows a schematic view of the left support plate of the preferred embodiment of the present invention.

As shown in FIGS. 1–5, an adjustable dumbbell 20 embodied in the present invention is formed of a carrying seat 30, a plurality of weights 40, and a selection device 50.

The carrying seat 30 has a left support plate 31 and right support plate 32. The left support plate 31 is provided with a display hole 33. The right support plate 32 is provided in the inner side with a protruded portion 34 which is in turn provided with a blind hole 342. Disposed between the two support plates 31 and 32 is a round rod 35 having a longitudinal through hole 36 and a side through hole 37. The carrying seat 30 is provided with a grip which is formed of four grip rods 38. The grip rods 38 are fastened between the two support plates 31 and 32.

The weights 40 are made of metal by casting and are formed of two symmetrical weight bodies 42, with each having two coaxial through holes 44. The weights 40 are held by the carrying seat 30 by means of two connection rods 43 held between the two weight bodies 42.

The selection device 50 comprises a connection tube 51 which is received in the round rod 35 and is provided at both ends thereof with four retaining recesses 512. Two rotary rods 52 and 53 are disposed between the through holes 36 of the connection tube 51. The right rotary rod 53 is marked with numerals which are visible through the through hole 37 and are indicative of the number of weights 40 being carried by the dumbbell 20. The right rotary rod 53 is provided with outer threads, which are meshed with a toothed ring 54. The toothed ring 54 are provided with four retaining projections 542, which are retained in the four recesses 512 of the connection tube 51, thereby enabling the right rotary rod 53 to turn along with the connection tube 51. A rotary knob 55 is engaged with the toothed ring 54 and is provided with two retaining holes 552. A stop member 56 is provided with a control switch 57 and a stop portion 58 which is provided with a protuberance 582 capable of actuating by the control switch 57 to engage or disengage the retaining holes 552. A slide member 59 is received in the blind hole 342 of the protruded portion 34 and is provided with a spring 592 and a steel ball 594 which urges the rotary knob 55 so as to stabilize the rotary knob 55 at the time when the rotary knob 55 is turned. The left rotary rod 52 is fitted into a sleeve 60 which is provided with four retaining portions 602 which are retained in the recesses 514 of the connection tube 51, thereby enabling the left rotary rod 52 to turn along with the connection tube 51. A rotary display 61 is pivoted with the left support plate 31 and is provided with a numbered wheel 612 having numerals marked thereon such that the numerals are visible through the display hole 33, and that the numerals are corresponding to the numerals of the right rotary rod 53. A ratchet wheel member 62 is formed of an upper ratchet 63, a connection rod 64 connected with the upper ratchet 63, and a lower ratchet 65 connected with the connection rod 64. The upper ratchet 63 is meshed with the numbered wheel 612, whereas the lower ratchet 65 is meshed with the outer threads of the left rotary rod 52.

In the process of selecting the load of the dumbbell 20 of the present invention, the control switch 57 of the stop member 56 is pushed rightwards to enable the protuberance 582 of the stop portion 58 to disengage the retaining hole 552 of the rotary knob 55. Thereafter, the rotary knob 55 is turned to actuate the toothed ring 54, thereby causing the right rotary rod 53 to jut out of the through hole 36 to enter the through holes 44 of the desired weights 40. In the meantime, the number indicative of the load of the weights 40 is visible through the side through hole 37. In light of the connection tube 51 being actuated by the toothed ring 54, the sleeve 60 is driven to actuate the left rotary rod 52 to move out of the through hole 36, so as to enter the through holes 44 of the desired weights 40. The control switch 57 of the stop member 56 is then pushed leftwards to enable the protuberance 582 of the stop portion 58 to be retained in the retaining hole 552, thereby preventing the rotary knob 55 from sliding. As a result, the desired weights 40 are picked up by the two rotary rods 52 and 53. The desired weights 40 are reduced in number by turning the rotary knob 55 in reverse to cause the two rotary rods 52 and 53 to retract into the connection tube 51, so as to unload the weights 40.

As the left rotary 52 is extend outwards, the ratchet wheel 62 is actuated such that the rotary display 61 is turned. When the rotary knob 55 is turned a predetermined distance, the user of the dumbbell 20 can see the identical numerals through the display hole 33 and the side through hole 37, so as to enable the user of the dumbbell 20 to be aware of the load of the dumbbell 20 of the present invention.

What is claimed is:

1. An adjustable dumbbell comprising:

a carrying seat having a left support plate, a right support plate, and a connection member connecting said left support plate and said right support plate;

a plurality of weights, with each being formed of two symmetrical weight bodies, said weight bodies provided with a through hole and releasably held by said carrying seat, and two connection rods join respective pairs of weight bodies; and a selection device mounted on said carrying seat and formed of an internally threaded adjusting mechanism and two externally threaded rods slidably mounted to said carrying seat and controlled by said adjusting mechanism to move into or out of said through holes of respective weight bodies of said weights.

2. The adjustable dumbbell as defined in claim 1, wherein said left support plate and said right support plate of said carrying seat are coaxially provided with a through hole; wherein said two threaded rods of said selection device are controlled by said adjusting mechanism to move into and out of said through holes of said left support plate and said right support plate.

3. The adjustable dumbbell as defined in claim 1, wherein said adjusting mechanism of said selection device comprises:

a connection tube connected with said two threaded rods; and a rotary knob engaged with said connection tube whereby said connection tube is actuated by said rotary knob to move said two threaded rods into and out of said through holes of said weight bodies of said weights, said rotary knob provided with a retaining hole.

4. The adjustable dumbbell as defined in claim 3, wherein said adjusting mechanism further comprises a stop member having a control switch and stop portion, said stop portion provided with a protuberance, whereby said stop portion is actuated by said control switch such that said protuberance of said stop portion is retained in said retaining hole of said rotary knob, so as fix and rotary knob, said stop portion being further actuated by said control switch in such a manner that said protuberance of said stop portion is moved out of said retaining hole of said rotary knob, so as to free said rotary knob.

5. The adjustable dumbbell as defined in claim 3, wherein said adjusting mechanism further comprises a slide member which is retained by said carrying seat and is provided with a spring and a steel ball whereby said ball urges said rotary knob at such time when said rotary knob is turned, thereby stabilizing said rotary knob in motion.

6. The adjustable dumbbell as defined in claim 5, wherein said right support plate of said carrying scat is provided with a protruded portion having a blind hole; wherein said slide member is disposed in said blind hole of said protruded portion of said right support plate of said carrying seat.

7. The adjustable dumbbell as defined in claim 3, wherein said adjustable mechanism of said selection device further comprises a toothed ring and a sleeve, said tooth ring being provided with a plurality of retaining projections and connected with said connection tube such that said retaining properties of said toothed ring are retained in a plurality of retaining recesses of said connection tube, said toothed ring further being meshed with extend threads of one of said two threaded rods, said sleeve being provided with a plurality of retaining portions and fitted over other one of said two threaded rods such that said retaining portions of said sleeve are retained in a plurality of retaining recesses of said connection tube.

8. The adjustable dumbbell as defined in claim 1, wherein said selection device further comprises a rotary display linked with said threaded rods for showing the number of said weights which are loaded, said rotary display provided with a numbered wheel.

9. The adjustable dumbbell as defined in claim 8, wherein said selection device further comprises a ratchet wheel member which is formed of an upper ratchet, a connection rod connection with said upper ratchet, and a lower ratchet connected with said connection rod, said upper ratchet being meshed with said numbered wheel of said rotary display, said lower ratchet being meshed with extend threads of one of said threaded rods.

* * * * *